US007464474B2

(12) United States Patent
Ishida

(10) Patent No.: US 7,464,474 B2
(45) **Date of Patent: *Dec. 16, 2008**

(54) ERGONOMIC SHEARS

(76) Inventor: Takuya Ishida, 22681 Granite Way, Laguna Hills, CA (US) 92653

( * ) Notice: Subject to any disclaimer, the term of this patent is extended or adjusted under 35 U.S.C. 154(b) by 0 days.

This patent is subject to a terminal disclaimer.

(21) Appl. No.: 11/303,823

(22) Filed: Dec. 15, 2005

(65) Prior Publication Data

US 2007/0137048 A1 Jun. 21, 2007

(51) Int. Cl.
*B26B 13/20* (2006.01)

(52) U.S. Cl. ..... 30/232; 30/254

(58) Field of Classification Search ..... 30/232, 30/254, 341, 257, 231; D8/57
See application file for complete search history.

(56) References Cited

U.S. PATENT DOCUMENTS

| | | | | | |
|---|---|---|---|---|---|
| 85,500 | A * | 12/1868 | Witte | 30/341 |
| 183,404 | A * | 10/1876 | Locke | 30/134 |
| 547,264 | A * | 10/1895 | Jennings | 30/233 |
| 1,103,710 | A * | 7/1914 | Tourjee | 30/341 |
| 1,967,549 | A * | 7/1934 | Buda | 30/341 |
| 2,370,026 | A * | 2/1945 | Elia | 30/254 |
| 2,662,286 | A * | 12/1953 | Yeomans | 30/262 |
| D205,183 | S * | 7/1966 | Micklitsch | D8/57 |
| D239,910 | S * | 5/1976 | Megna | D8/57 |
| 4,635,363 | A * | 1/1987 | Chapin | 30/257 |
| 5,146,810 | A * | 9/1992 | Mueller | 74/558 |
| D383,959 | S * | 9/1997 | Litton | D8/57 |
| 6,249,977 | B1 * | 6/2001 | Knoop | 30/232 |
| 2005/0204569 | A1 * | 9/2005 | Brenton | 30/323 |
| 2006/0143930 | A1 * | 7/2006 | Adachi | 30/232 |
| 2007/0144013 | A1 * | 6/2007 | Ishida | 30/232 |

FOREIGN PATENT DOCUMENTS

DE 103 28 225 A1 * 1/2005

* cited by examiner

*Primary Examiner*—Hwei-Siu C Payer
(74) *Attorney, Agent, or Firm*—Paul J. Backofen, Esq.; Crockett & Crockett

(57) ABSTRACT

An ergonomic shear according to the present disclosure provides variations in finger relief to accommodate variations in human physiology and an aligning finger handle that aligns the users fingers into a minimum stress position relative to each other and to the thumb.

7 Claims, 3 Drawing Sheets

ERGONOMIC SHEARS

FIELD OF THE INVENTIONS

The inventions described below relate the field of cutting shears, and more specifically to the field of ergonomic shears for one-handed use.

BACKGROUND OF THE INVENTIONS

Conventional cutting shears for one-handed use are generally one size fits all. This approach may be sufficient for most people who use shears or scissors occasionally. The inexact fit of the shears or scissors with the shape and flexibility of the human hand causes limited problems.

Some portion of the population use shears or scissors in their chosen line of work, and for these people, the lack of exact fit of shears to the human hand is causing serious physical injury.

What is needed is a shear that is sized to engage the human hand to minimize stress and thus repetitive motion injuries.

SUMMARY

An ergonomic shear according to the present disclosure includes an aligning finger handle that aligns the users fingers into a minimum stress position relative to each other and to the thumb.

In another aspect of the present disclosure an ergonomic shear provides variations in finger relief to accommodate variations in human physiology.

In still another aspect of the present disclosure, the thumb handle of the shear is shortened to minimize the required movement to operate the shear and thus minimize stress on a users hand.

DETAILED DESCRIPTION OF THE INVENTIONS

Figure 1:
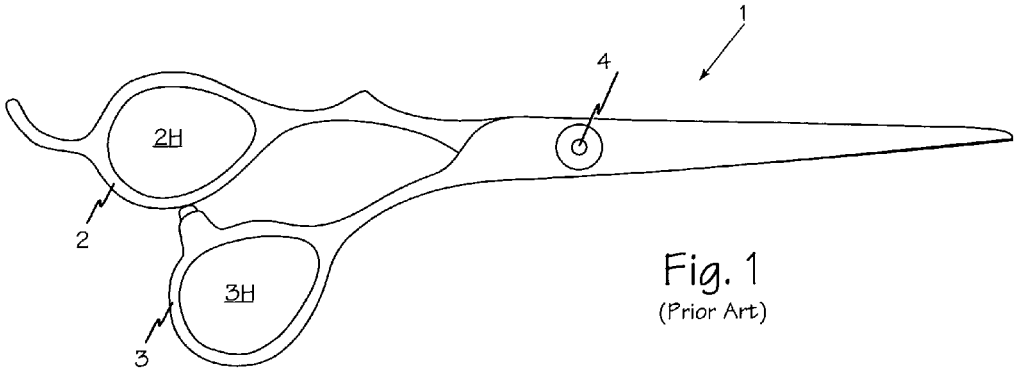
Fig. 1 (Prior Art)
FIG. 1 is a side view of a conventional pair of shears.

FIG. 1 illustrates conventional shears 1 with finger handle 2 and thumb handle 3 pivoting on pivot 4. The distances from finger hole 2H to pivot 4 is similar to the distance from thumb hole 3H to pivot 4. These distances provide mechanical advantage for cutting thick or heavy material.

Figure 2:
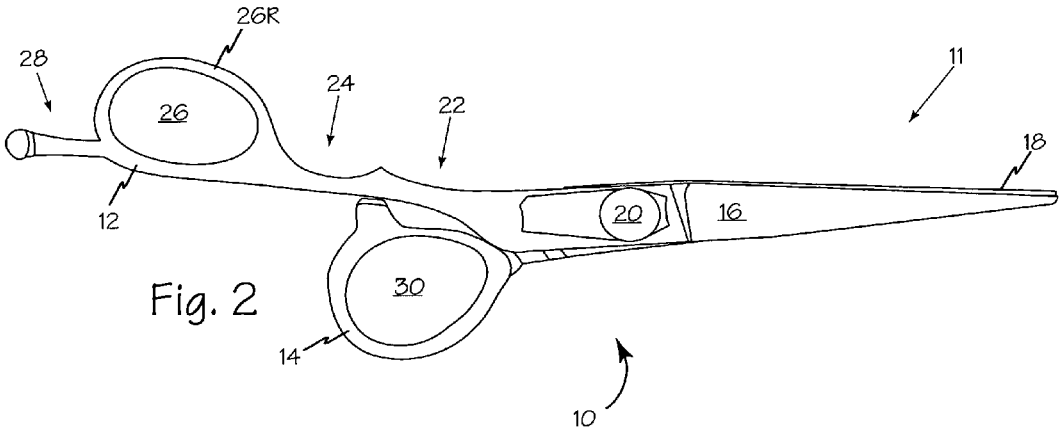
FIG. 2 is a side view of closed ergonomic shears according to the present disclosure.
Figure 3:
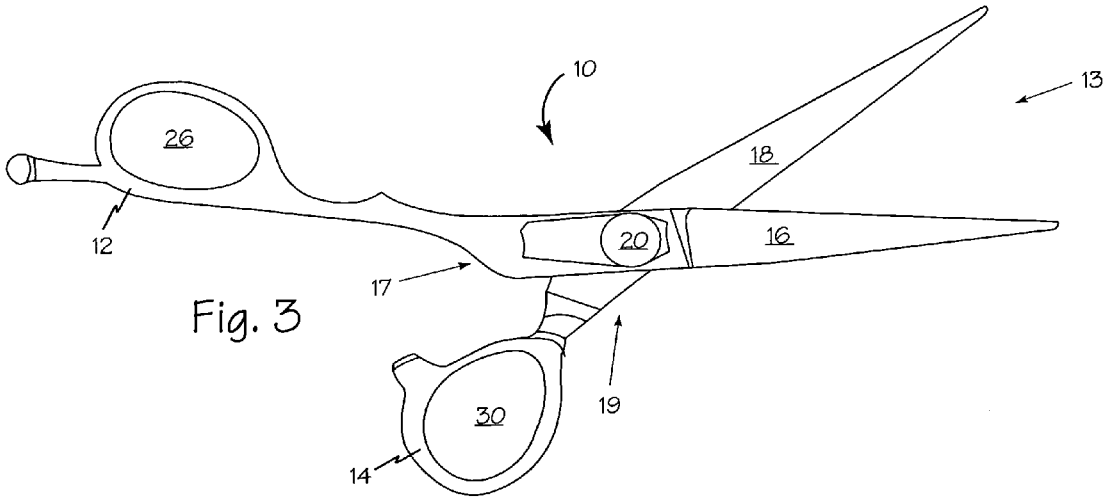
FIG. 3 is a side view of open ergonomic shears according to the present disclosure.

FIG. 2 illustrates ergonomic scissors or shears 10 in primary or closed position 13, and FIG. 3 illustrates shear 10 in secondary or open position 13. Shear 10 includes handles 12 and 14 connected to blades 16 and 18 respectively which pivot about pivot 20. Finger handle 12 includes finger positions 22, 24, 26 and 28. Third finger position 26 is enclosed by retainer 26R. Thumb handle 14 includes thumb hole 30. The pair of shears 10 surrenders some mechanical advantage by shortening the distance from thumb hole 30 to pivot 20 compared to conventional devices. The benefits are improved ergonomic fit with human hands and minimized thumb movement by shortening the lever arm between the thumb hole and the pivot. Minimal thumb movement results in proportionally large movement of the tip of thumb blade 18.

Finger assembly 17 is formed by the combination of finger handle 12 with finger blade 16. Thumb assembly 19 is formed by the combination of thumb handle 14 with thumb blade 18.

Figure 4:
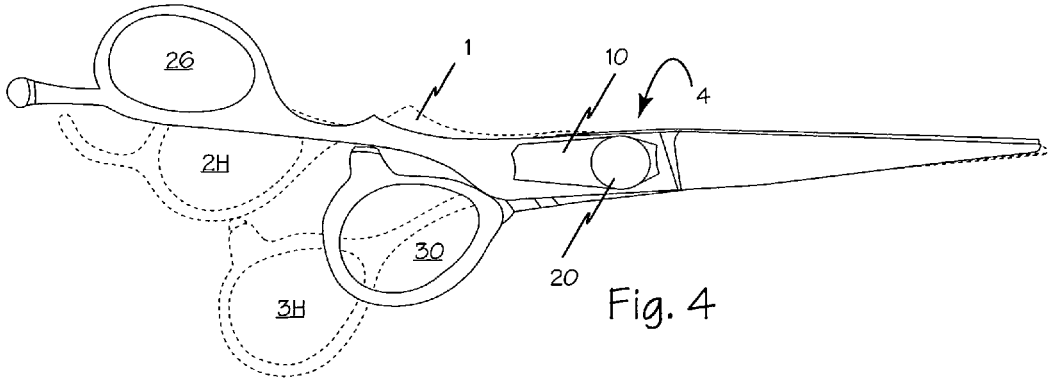
FIG. 4 is a side view of closed ergonomic shears according to the present disclosure overlaid on the pair of conventional shears of FIG. 1.

FIG. 4 illustrates a comparison between conventional shears 1 and ergonomic shears 10 with pivot 4 and pivot 20 aligned. Thumb hole 30 of shears 10 is closer to pivot 20 than thumb hole 3H is to pivot 4. Third finger position 26 is slightly farther from pivot 20 than finger hole 2H is from pivot 4. The alignment of third finger position 26 that enables finger positions 22, 24, 26 and 28 to be in a straight line is also illustrated.

Figure 5:
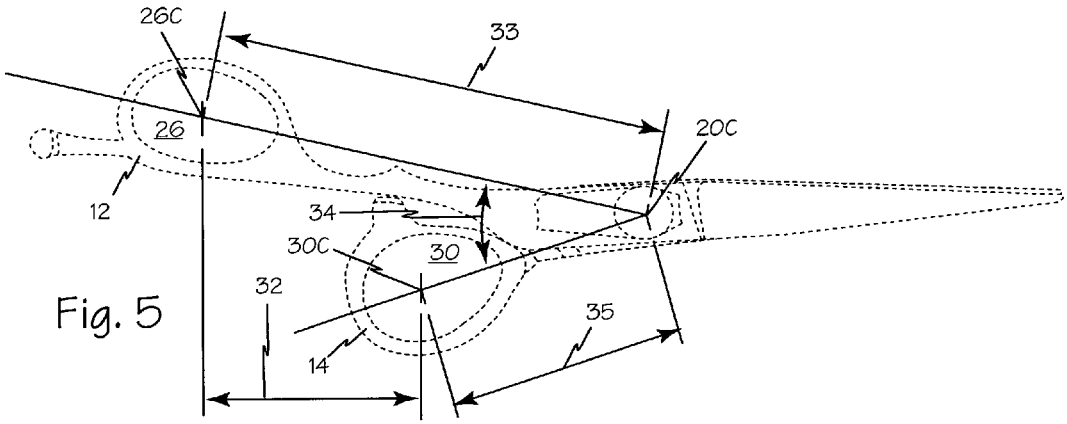
FIG. 5 is a side view illustration of the geometry of the closed ergonomic shears of FIG. 2.

Referring now to FIG. 5, the pair of ergonomic shears 10 may be produced in varying sizes and dimensions to minimize stress on a users hand. Finger relief distance 32 is determined in closed position 11 and may be from 1" to 2¼" to accommodate variations in human hand dimensions. Handle angle 34 is derived from a straight line from pivot center 20C through thumb hole center 30C and a straight line from pivot center 20C through third finger position center 26C with the shear in closed position 11. Any suitable handle angle 34 may be used with preferred handle angles between 12° and 48°.

Length 33 of finger handle 12 is generally determined by the distance from third finger position 26 to pivot 20. The length 35 of thumb handle 14 may be selected according the material to be cut by shears 10. Heavier material will necessitate lengthening thumb handle 14. The pair of ergonomic shears 10 as illustrated may be suitable for cutting hair or other relatively soft materials. Selection of length 35 to be between ⅓ and ⅔ of length 33 will enable suitable finger relief and produce an ergonomic benefit. The relatively short length 35 enables minimum movement of thumb handle 14 to cause greater movement of thumb blade 18. This advantage will require less movement of the thumb to cut hair or other soft materials thus minimizing stress on a user's hand.

Figure 6:
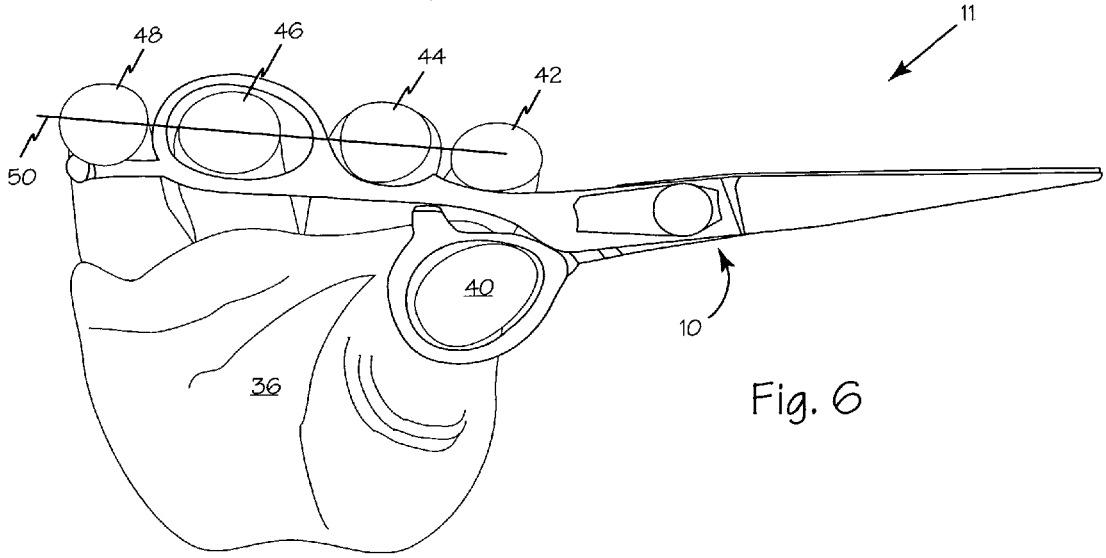
FIG. 6 is a side view of the ergonomic shears of FIG. 2 engaged by a user's hand.

Referring now to FIG. 6, selection of an appropriate finger relief distance 32 and corresponding handle angle 34 will permit a user's hand 36 to engage shear 10 with fingers 42, 44, 46 and 48 aligned along straight line 50. In primary orientation 11, the alignment of fingers 42, 44, 46 and 48 minimizes stress on a user's hand and fingers while maximizing a user's control over ergonomic shear 10.

Figure 7:
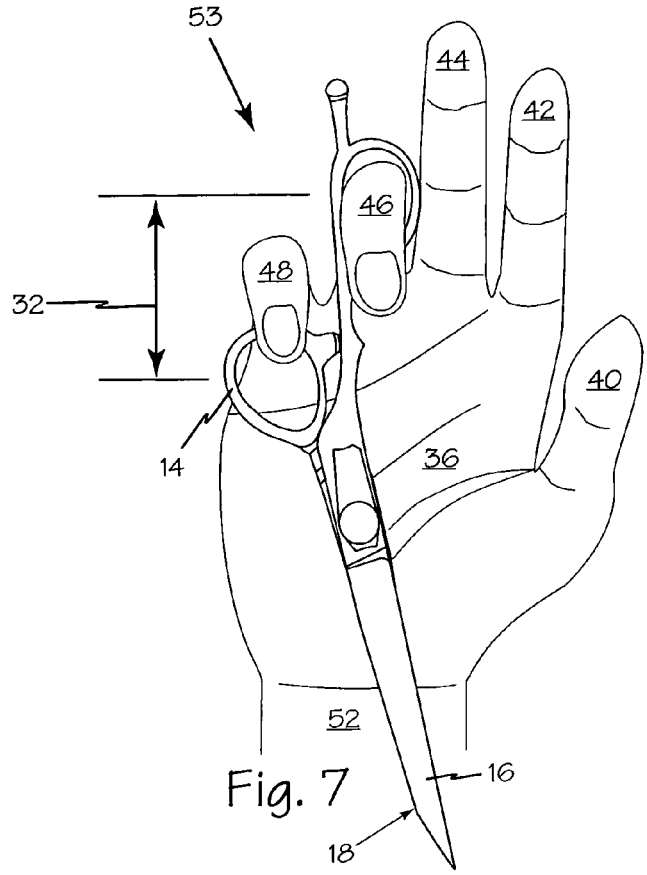
FIG. 7 is a side view of the ergonomic shears of FIG. 2 in a standby position in a user's hand.

Referring now to FIG. 7, in use a user may permit ergonomic shears 10 to rotate about third finger position 26 allowing the small finger, fourth finger 48, to engage thumb handle 14 as shown. Finger relief distance 32 and the resulting angular separation of third finger position 26 and thumb hole 30 permits blades 16 and 18 to rest along a user's wrist 52. Standby orientation 53 frees user's fingers 42, 44 and thumb 40 to be used without the interference and danger posed by ergonomic shears 10.

Figure 8:
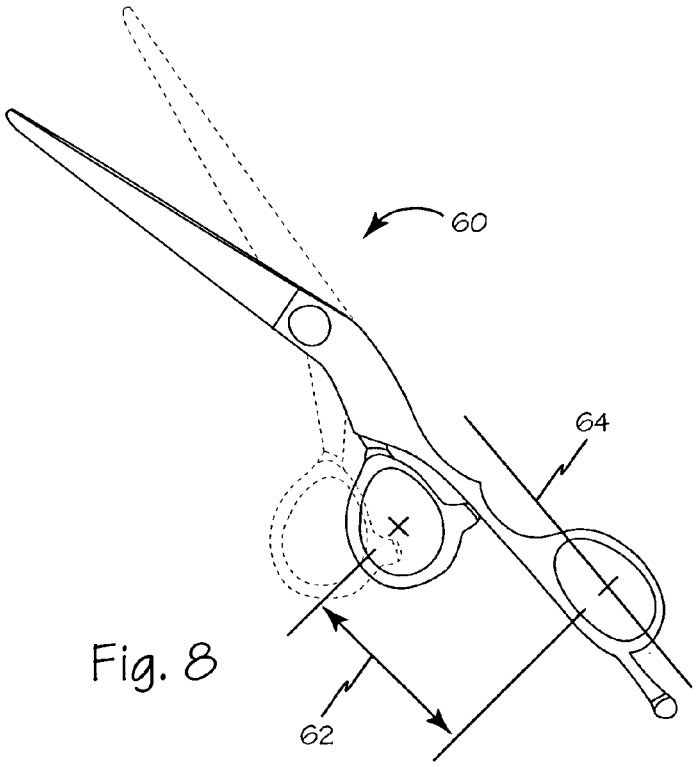
FIG. 8 is an alternate configuration of ergonomic shears according to the present disclosure.

Alternatively, ergonomic shears according to the present disclosure may adopt any other suitable orientations such as illustrated in FIG. 8. Ergonomic shears 60 maintain a suitable finger relief distance 62 as well as a straight finger alignment 64.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

I claim:

1. Ergonomic shears comprising:

a finger assembly including a finger handle joined to a finger blade, the finger handle having a first, second, third and fourth finger positions to engage respectively, a first, second, third and fourth fingers of a user's hand, the four finger positions aligned in a straight line with the first, second and fourth finger position open;

a thumb assembly including a thumb handle joined to a thumb blade at a pivot point, oriented to engage a user's thumb at a thumb position perpendicular to the thumb handle with the thumb oriented relative to the first finger such that a line drawn between the thumb position and the first finger position is generally perpendicular to the straight line with the shears in a closed position wherein the thumb handle extends only from the pivot pint to the thumb position; and a pivot joining the finger assembly to the thumb assembly permitting counter rotation of the finger assembly and the thumb assembly about the pivot from a closed position to an open position and from the open position to the closed position, and the thumb position is spaced a shorter distance from the pivot than the second finger position.

2. The ergonomic shears of claim 1 wherein the third finger position further comprises a retainer encircling the third finger position, the retainer engaging the user's third finger.

3. The ergonomic shears of claim 2 wherein the encircled third finger position includes a center, and the thumb handle includes a thumb hole having a center, the distance from the center of the third finger position and the center of the thumb hole is from 1 inch to 2¼ inches with the ergonomic shear in the closed position.

4. The ergonomic shears of claim 2 wherein the encircled third finger position includes a center, and the thumb handle includes a thumb hole having a center, and an angle is formed between a line from the center of the third finger position to the pivot and a line from the center of the thumb hole to the pivot, the angle is from 12° to 48° with the ergonomic shear in the closed position.

5. Ergonomic shears comprising:

a finger assembly including a finger handle joined to a finger blade, the finger handle having a first, second, third and fourth finger positions to engage respectively, a first, second, third and fourth fingers of a user's hand, the four finger positions aligned in a straight line with the first, second and fourth finger positions open and the third finger position includes a retainer encircling the third finger position defining a hole having a center, the retainer engaging the user's third finger, wherein the finger handle and the finger blade are generally coplanar;

a thumb assembly including a thumb handle joined to a thumb blade, the thumb handle including a thumb hole having a center oriented to engage a user's thumb at a thumb position perpendicular to the thumb handle with the thumb oriented relative to the first finger such that a line drawn between the thumb position and the first finger position is generally perpendicular to the straight line with the shears in a closed position, wherein the finger handle and the thumb blade are generally coplanar; and a pivot joining the finger assembly to the thumb assembly permitting counter rotation of the finger assembly and the thumb assembly about the pivot from the closed position to an open position and from the open position to the closed position, and the thumb position is spaced a shorter distance from the pivot than the second finger position.

6. The ergonomic shears of claim 5 wherein, the distance from the center of the third finger position and the center of the thumb hole is from 1 inch to 2¼ inches with the ergonomic shears in the closed position.

7. The ergonomic shears of claim 5 wherein, and an angle is formed between a line from the center of the third finger position to the pivot and a line from the center of the thumb hole to the pivot, the angle is from 12° to 48° with the ergonomic shears in the closed position.

* * * * *